US006799886B2

(12) United States Patent
Carrard et al.

(10) Patent No.: US 6,799,886 B2
(45) Date of Patent: Oct. 5, 2004

(54) WATCH CASE

(75) Inventors: Jean-Daniel Carrard, Yverdon (CH); Francois Burgener, Auvernier (CH); Olivier Steiner, Neuchatel (CH)

(73) Assignee: TAG-Heuer SA, Marin (CH)

( * ) Notice: Subject to any disclaimer, the term of this patent is extended or adjusted under 35 U.S.C. 154(b) by 75 days.

(21) Appl. No.: 10/447,366

(22) Filed: May 29, 2003

(65) Prior Publication Data

US 2003/0206493 A1 Nov. 6, 2003

Related U.S. Application Data

(63) Continuation of application No. PCT/CH01/00542, filed on Sep. 7, 2001.

(30) Foreign Application Priority Data

Dec. 1, 2000 (CH) ..... 2337/00

(51) Int. Cl.[7] ..... A44C 5/00; G04B 37/00; G04B 34/00

(52) U.S. Cl. ..... 368/281; 368/295

(58) Field of Search ..... 368/76, 80, 88, 368/134, 179, 223, 228, 276, 281, 294, 295

(56) References Cited

U.S. PATENT DOCUMENTS 4,038,814 A * 8/1977 Niida ..... 368/69
4,244,044 A 1/1981 Olsson
4,712,925 A * 12/1987 Beebe ..... 368/179
4,985,877 A * 1/1991 Namisato ..... 368/76
5,850,373 A * 12/1998 Lee ..... 368/65
6,388,953 B1 * 5/2002 Wu ..... 368/76

FOREIGN PATENT DOCUMENTS

| | | |
|---|---|---|
| CH | 346 169 A | 4/1960 |
| DE | 20 10 941 A | 9/1971 |
| FR | 2 548 797 A | 1/1985 |

* cited by examiner

*Primary Examiner*—Vit W. Miska
(74) *Attorney, Agent, or Firm*—Pearne & Gordon LLP

(57) ABSTRACT

Watch case comprising a casing (10), a turning bezel (14-2) outside of said casing, said turning bezel comprising at least one portion of magnetic material (2), an organ (11) inside of said casing, placed so as to be able to be controlled by the magnetic field of said magnetic portion, said organ (11) comprising a concentric ring (4) to said turning bezel and equipped with at least one magnetic portion, so as to be able to be driven in rotation by the magnetic field of said organ during its rotation, and wherein said organ is of the analogue type and can take an infinite number of distinct positions according to the angular position of the turning bezel.

30 Claims, 5 Drawing Sheets

WATCH CASE

This application is a continuation of application PCT/CH01/00542 (WO0244818), filed on Sep. 7, 2001, the contents of which are hereby incorporated by reference. This application further claims the priority of application CH 2000 2337/00, filed on Dec. 1, 2000, the contents of which are hereby incorporated by reference.

FIELD OF THE INVENTION

The present invention concerns a watch case, in particular a watch case comprising a turning bezel and display or control elements inside the casing.

RELATED ART

Numerous watches and watch cases are equipped with a turning bezel to display and control different functions of the watch. A frequent use of turning bezels consists in indicating a remaining diving time. The bezel is in this case fitted with a graduation scale that corresponds to the minutes traveled by the minutes hand of the watch; colored segments on the bezel are sometimes used that for example allow the diver to very quickly detect when it is time to go back up when the handle points in the direction of a red area.

These bezels, however, have the inconvenience of necessitating a considerable width in order to display visibly, even under water, the graduations and the colored zones. The notching and fixing mechanism of the bezel, for example a side spring, must also be resistant to the strong forces that can be exerted on it by the user. The width of the bezel is therefore generally dependent on the size of the information made available and by the dimension of the notching and fixing system, both of which put considerable aesthetic constraints on the design of the watch.

Are also known watch cases, like for example as described in patent CH662235 (Nouvelle Lemania SA), wherein the bezel is used to control different functions within the watch, notably the winding or time setting. In this document the bezel is in direct contact with the driven components, which makes the construction complex and requires joints to be provided between the bezel and the casing in order to ensure that it is waterproof.

Another watch in which the bezel directly drives different functions of the watch is described in patent CH343293 (R. Jecker-Meyer). CH687285 (R. Valentini SA) describes another watch in which the illumination of the clock face is controlled by the rotation of the bezel. CH685584 (Paul Feuz) describes a universal watch that allows to select the time zone by turning the bezel. CH486728 (E. Piquerez) describes a watch comprising an external turning bezel driving an internal bezel with the help of a gear. All these watches share the inconvenience of a mechanical linking between the external turning bezel and the element or function controlled inside the watch. It is therefore necessary to provide means to make this link watertight, for example with the help of a circular joint under the bezel. These joints, however, have the disadvantage of becoming deformed after repeated manipulations of the bezel. These constructions therefore are not suited to watches that must satisfy high demands, notably diving watches destined to be used at great depths.

Patent application WO99/26117 (Seiko Epson) describes a watch case comprising a turning bezel, wherein a photoelectric measurement system on the outside of the casing supplies to the electronics of the watch a signal corresponding to the position of the bezel. This solution is complex and costly to put into practice. Furthermore, the photodetectors consume electricity that must be drawn from the watch's battery. The electric connection between the measuring system and the watch's movement requires several wires that traverse the casing, which could cause a water infiltration problem.

Patent EP-B1-0738944 (Asulab SA) describes a watch comprising a turning outer ring equipped with permanent magnets. Mechanical means force the ring to adopt one of 24 predefined rotational positions. The chosen position is detected by means of several magnetic switches inside the watch, the status of the different switches defining a numerical signal that corresponds to the position of the outer ring and that is supplied to the watch's electronics.

Similar devices also comprising magnetic switches inside the watch and operated by outer magnets are described in patent application CH-A3-613088 (Cetehor) and in application DE-2501973 (A. Meitinger).

These solutions using magnetic switches are costly. Each magnetic switch is a source of potential failure, which causes a reliability problem if a large number of switches are used. Moreover, the outer ring can take up and display only a limited discrete number of positions, for example 24. An increase in the number of positions is only possible at the price of increasing the number of magnetic switches and therefore the price and the diameter of the watch. Furthermore, they can only be used in electronic watches for which it is additionally necessary to modify the circuit so that it reacts to the signals supplied by the magnetic switches.

Patent application DE2010941 describes a watertight watch that can be set by making the whole casing and the movement pivot. The clock face remains however held in the same relative position with respect to the bracelet thanks to magnets. The aim of this construction is to do away with the hole traversing through the casing for the winding-up stem. The watch is however devoid of bezel. This construction comprising a turning casing imposes considerable aesthetic constraints. It is not possible to control additional functions of the watch by pivoting the casing.

It is thus one aim of the invention to propose a watch case that avoids the disadvantages of the aforementioned watch cases.

In particular, it is an aim of this invention to propose a watch case equipped with a turning bezel allowing to control the indications of the watch and said bezel having a width that is not determined by the size of the information to be displayed.

It is another aim of this invention to propose a watch case equipped with a turning bezel allowing to control the indications of the watch and that can be used with mechanical movements as well as with electronic quartz movements without the compulsory modification of the latter and without increasing their power consumption.

Another aim of the invention is to propose a watch case equipped with a turning bezel allowing to control the indications of the watch and whose reliability is increased compared to the prior art watch cases. In particular, it is an aim of this invention to propose a watch case with a reduced number of joints and magnetic switches.

BRIEF SUMMARY OF THE INVENTION

According to the invention, these aims are achieved by means of a watch case comprising a casing, a turning bezel outside of said casing, the turning bezel comprising at least a portion of magnetic material, an organ inside said casing being disposed so as to be able to be controlled by magnetic attraction with said portion, and wherein said organ is of the analogue kind and can take up an infinity of distinct positions according to the angular position of said bezel.

According to the invention, these aims are also achieved by means of a watch case comprising a casing, a turning bezel outside of said casing, the turning bezel comprising at least a portion of magnetic material, an organ inside said casing being disposed so as to be able to be controlled by magnetic attraction with said portion, and wherein said organ comprises a concentric element to said bezel and is equipped with a plurality of magnetic portions so as to be able to be driven in rotation by the magnetic field of said bezel when it is in rotation.

Preferably, the information or the function controlled by manually turning the bezel is not supplied on the bezel itself, but on an organ inside the watch case. It is thus possible to make much thinner bezels whose width is not dictated by the size of the indications.

Preferably, only the organ driven inside the watch case is fitted with a system for controlling the direction of rotation, whereas the bezel is free to turn in both directions. Thus, the bezel can be very thin, allowing for new aesthetic possibilities. As the organ is driven only by a relatively weak movement by means of the magnetic field, it is not necessary to provide a very voluminous system for controlling the direction of rotation.

This solution also has the advantage that the rotation of the bezel is transmitted without any contact to the organ through the casing. It is therefore not necessary to provide holes or openings across the casing, which allows an elegant solution to the problem of waterproofing.

Furthermore, this solution offers the advantage of being able to be used with any type of watch movement to control an analogue organ, for example an additional display. Additionally, it does not require further electricity and does therefore not drain the watch's battery.

DESCRIPTION OF THE DRAWINGS

The invention will be better understood with reference to the description of an embodiment illustrated by the attached drawings containing the figures, in which.

DETAILED DESCRIPTION OF THE INVENTION

Figure 1:
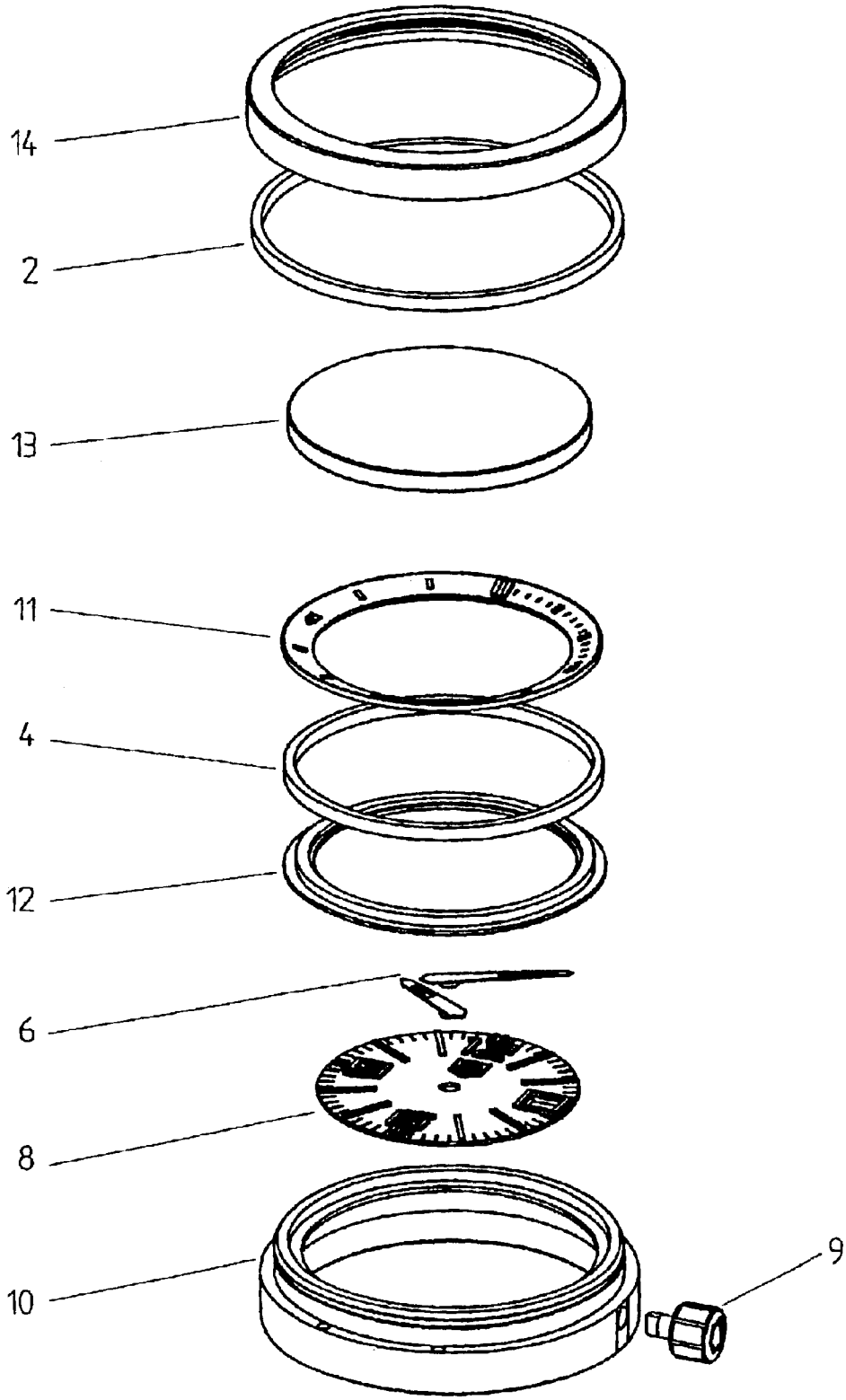
FIG. 1 shows an exploded view of a watch case according to the invention.
Figure 2:
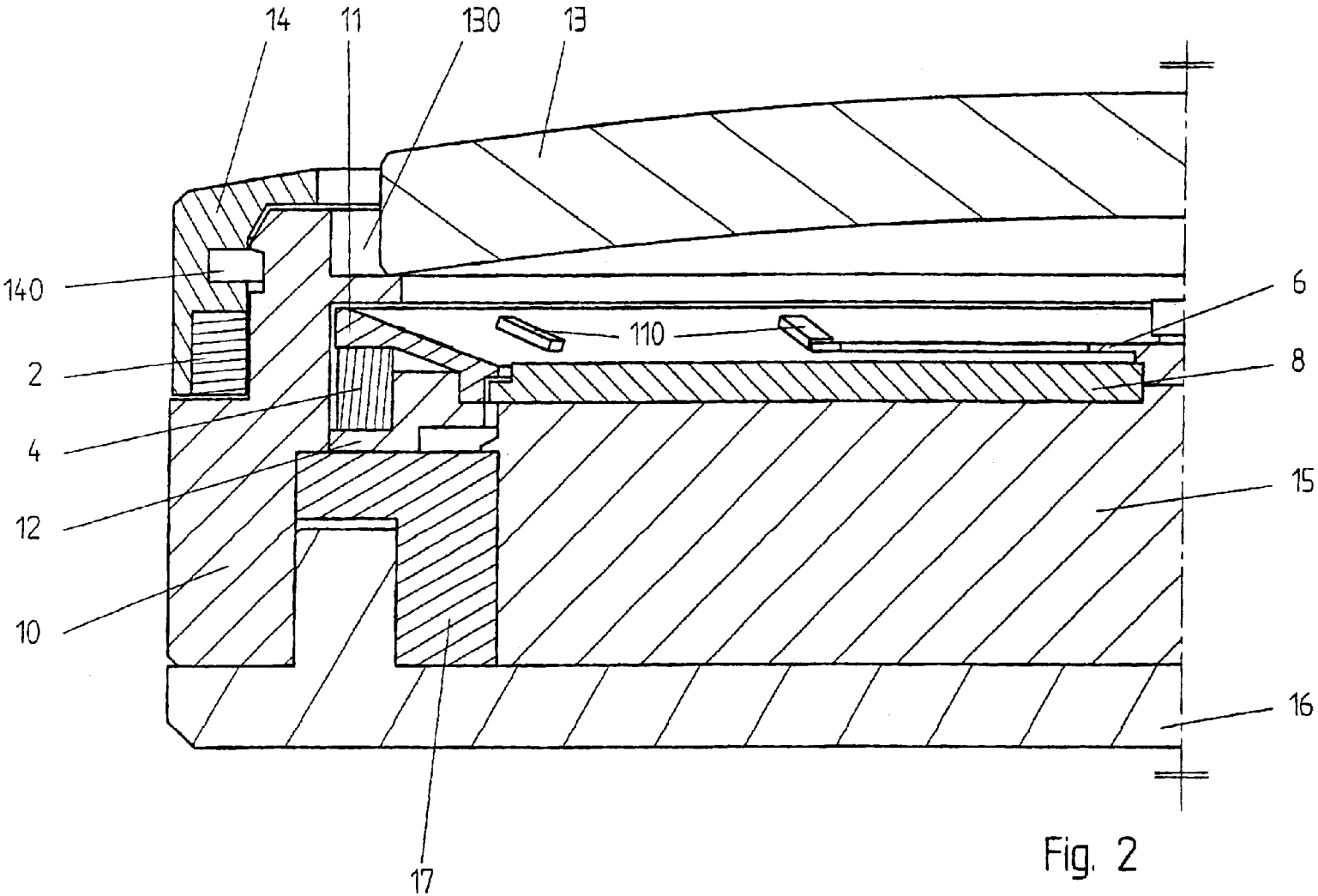
FIG. 2 shows a partial cross section view of a watch case according to the invention.

FIGS. 1 and 2 illustrate a watch case comprising a casing 10 and a turning bezel 14 that can be turned manually in relation to the casing 10. The casing is made of non-magnetic material. Depending on the function operated, not-represented notching means can be provided to avoid the rotation of the bezel in one or the other direction of rotation; furthermore, means can be provided to force the bezel to adopt a limited number of predefined angular positions. An elastic system 140 enables the bezel to be held on the casing by adjusting the necessary moment for rotating the bezel 14 with respect to the casing 10.

The watch case comprises also a back cover 16 (visible in FIG. 2) and a fitting ring 17 designed to hold the movement 15 of the watch. The movement drives the indicators 6, for example hands 6 and/or a date disk, not represented, which displays the hour and other possible information. One or several winding-up mechanisms 9 and/or push buttons, not represented, allow time setting of the movement and control of additional functions.

The illustrated watch further comprises a clock face 8 as well as a glass 13 that is maintained by a joint 130 against the casing 10. A flange 11 on the periphery of the clock face carries additional information 110, for example a remaining diving time, color areas, etc.

According to the invention, the bezel 14 also comprises at least a magnetic portion capable of operating an analogue indicating organ inside the watch. In the example illustrated, the bezel 14 comprises a permanent ring-shaped magnet 2 fitted with several ring-shaped segments magnetized with alternating polarities. The analogue indicating organ consists of the flange 11 provided with indicators 110 and equipped with a second permanent ring-shaped magnet 4, concentric to the magnet 2, and also equipped with several ring-shaped segments magnetized with alternating polarities. The number of magnetized segments is preferably the same on both ring-shaped magnets 2 and 4 in order to guarantee a synchronous rotation of the two rings. Preferably, small-sized magnetized angular segments will be chosen in order to limit the backlash when the segments of the external ring 2 are not opposite the segments of the internal ring 4.

In the illustrated embodiment, the external magnet 2 is glued onto the bezel 14 whereas the internal magnet 4 is wedged between the flange 11 and a lower supporting ring 12. The two rings preferably consist of noble earth (neodymium-iron-boron or samarium-cobalt, for example) and are made by sintering in an oven from compacted powder. The invention is however not limited to these particular examples and other shapes and types of magnets might be used. It is equally possible in a variant embodiment to replace one or both of the rings 2 and/or 4 by one or several discrete magnets mounted in the periphery of the bezel or of the flange, respectively. Finally, in a variant embodiment, only the bezel 14 or the organ 11 is fitted with one or several permanent magnets whereas the other element comprises at least one portion of non-permanent magnetic material, for example soft iron, capable of being attracted by these magnets.

By turning the bezel 14, the magnetic field produced by the permanent external magnet 2 is displaced so that the internal magnet 4 and its associated flange are moved. It is thus possible to control the angular position of the flange in an uninterrupted manner from the exterior of the casing and to control the position of the indications, for example the remaining diving time, on the flange 11.

It is thus possible to control from the outside of the watch the information displayed by organs inside the watch. Depending on the type of glass 13 used, the information 110 displayed on the controlled display organ can be enlarged by magnifying effect, notably under water.

In a preferred embodiment of the invention, a device for controlling the direction of the rotation is provided to prevent the rotation of the flange 11 in one of the two rotation directions, the bezel 14 being free to turn in both directions. The device for controlling the direction of rotation is thus placed inside the waterproofed casing of the watch and less subject to perturbations caused by dust particles or splashes of liquid. Furthermore, it is possible to use an organ of small size, since the user does not act directly on the flange: it is enough that the moment of blocking is higher than the maximal driving coupling of the magnetic bezel 14. The bezel can in this case be turned in both directions; in the first direction, with a relatively small moment determined chiefly by the spring blade 140, by driving the device 11; in the other direction, with a greater moment corresponding to the sum of the action of the spring blade 140 and of the attraction of the internal magnet 4 that remains fixed.

Figure 3:
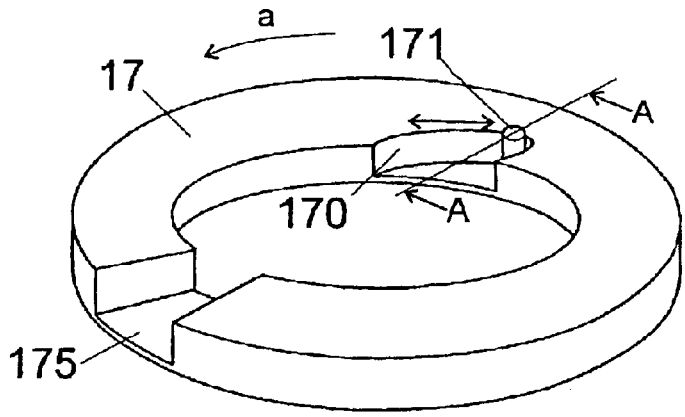
FIG. 3 shows a perspective view of a fitting ring provided with an organ for controlling the direction of rotation according to a first embodiment of the invention.
Figure 4:
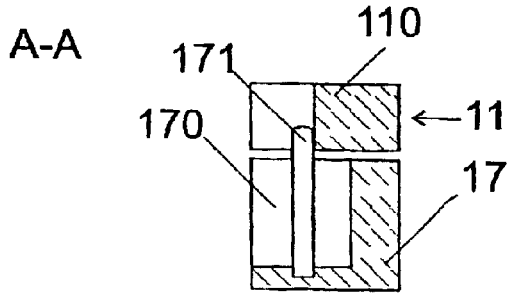
FIG. 4 shows a cross section along the line A—A of the fitting ring illustrated in FIG. 3 and of the flange.

A first embodiment of the device for controlling the direction of rotation is illustrated in FIGS. 3 to 5*b*. FIG. 3 illustrates a perspective view of the fitting ring 17 modified for this purpose. The ring, which can be made of synthetic material or of non-magnetic metal, for example brass, comprises a split or opening 175 for the not-represented crown pin. A second split 170 drilled into the fitting ring 17 houses a flexible metallic pin 171 (steel wire) that is slantingly mounted perpendicularly to the fitting ring, so as to protrude over it. The free extremity of the pin 171 can thus be bent by using a reduced force. The shape of the split 170 however prevents the pin 171 from bending in any direction.

The free extremity of the pin 171 is engaged in a notched cage 110 under the magnetized part of the flange 11. The notched cage 110 is provided along its whole periphery with saw-toothed notches comprising a first flank 111 that is relatively steep and a second flank 112 that is less steep, as can be seen in particular in FIGS. 5*a* and 5*b*.

Figure 5A:
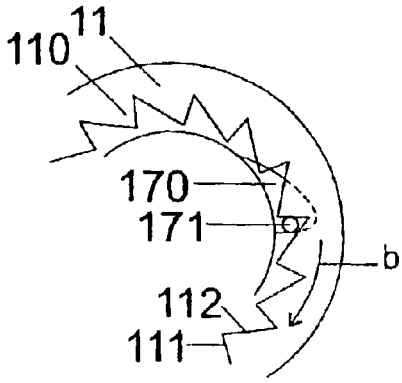
FIGS. 5*a* and 5*b* show two schematic top views of the flange and the fitting ring according to the first embodiment of the device for controlling the direction of rotation.
Figure 5B:
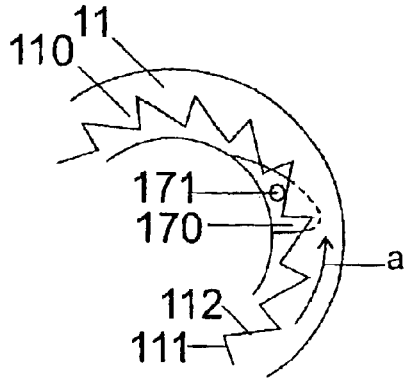

When the flange 11 is driven clockwise by the magnetic field of the bezel, as illustrated in FIG. 5*b* by the arrow b, the flank 111 of the notch 110 closest to the pin 171 pushes the latter in the same direction b. The bending of the pin 117 is, however, prevented by the particular shape of the split 170 in the fitting ring 17. The flange's driving moment is relatively small so that the pin 117 stays straight and thus succeeds in holding back the rotation of the flange 11.

When the user drives the flange 11 anti-clockwise as illustrated in FIG. 5*b* by the arrow a, the flank 112 of the notch 110 slowly pushes the pin 171 in the same direction a and towards the interior of the ring. The split 170 is sufficiently deep in this direction to allow the pin 171 to bend until the point where it manages to pass over the head of the tooth 110. The rotation of the flange 11 is thus possible in the direction of the arrow a.

Figure 6:
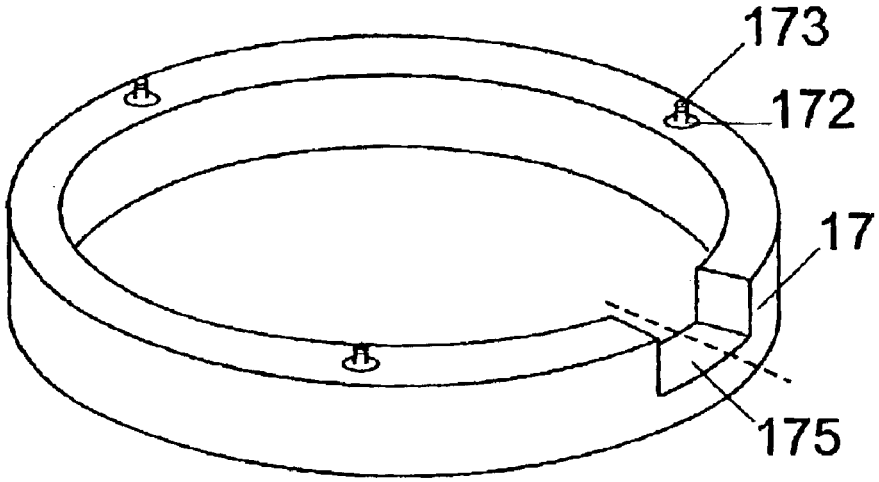
FIG. 6 shows a perspective view of a fitting ring equipped with the device for controlling the direction of rotation according to a second embodiment of the invention.
Figure 7:
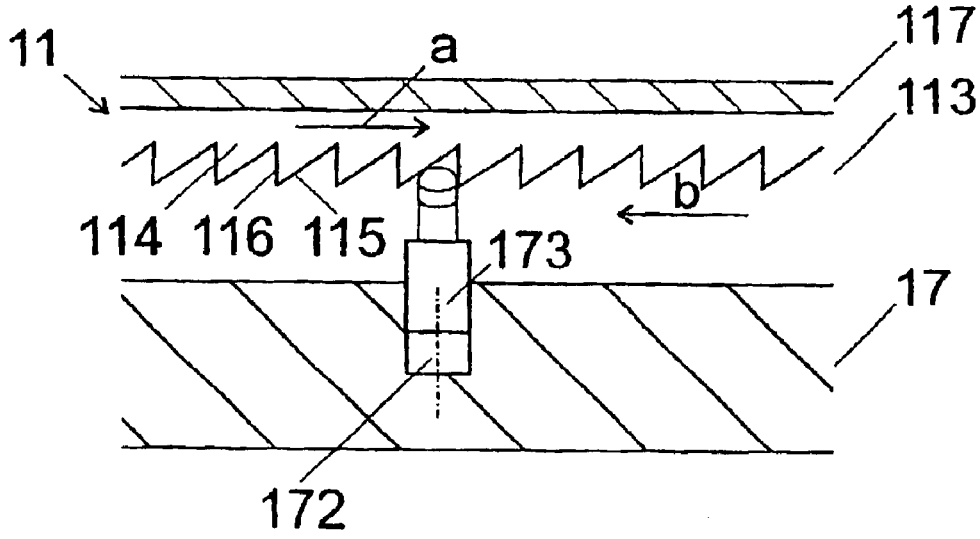
FIG. 7 shows a cross section of the fitting ring illustrated in FIG. 6 and of the flange.

FIGS. 6 and 7 show a second embodiment of the invention wherein the device for controlling the direction of rotation of the flange uses the latter's magnetization. The device includes in this embodiment a plurality of pins 173 of magnetic material and placed freely in openings 172 in the fitting ring 17. The flange magnetically attracts the pins 173 partially outside of the openings 172. An optional spring, not represented, can possibly be provided at the bottom of the openings 172 to control the vertical force exerted on each of the pins 173.

The flange comprises a notched cage 114 mounted under the magnetized part 117, as in the first embodiment of the invention illustrated in the FIGS. 3 to 5*b*. The notched cage 114 comprises all along its periphery notches 114, each comprising a relatively steep flank 116 and a less steep flank 115.

When the flange is driven anti-clockwise, as illustrated by the arrow a, the less steep flank 115 slowly pushes back the pin 173 in the opening 172, thus allowing the head of the notch 114 to pass. In the other direction illustrated by the arrow b, the steep flank 116 exerts an exclusively lateral force against the pin 173 that remains completely protruding outside of the opening 172, thus preventing the rotation of the flange.

Figure 8:
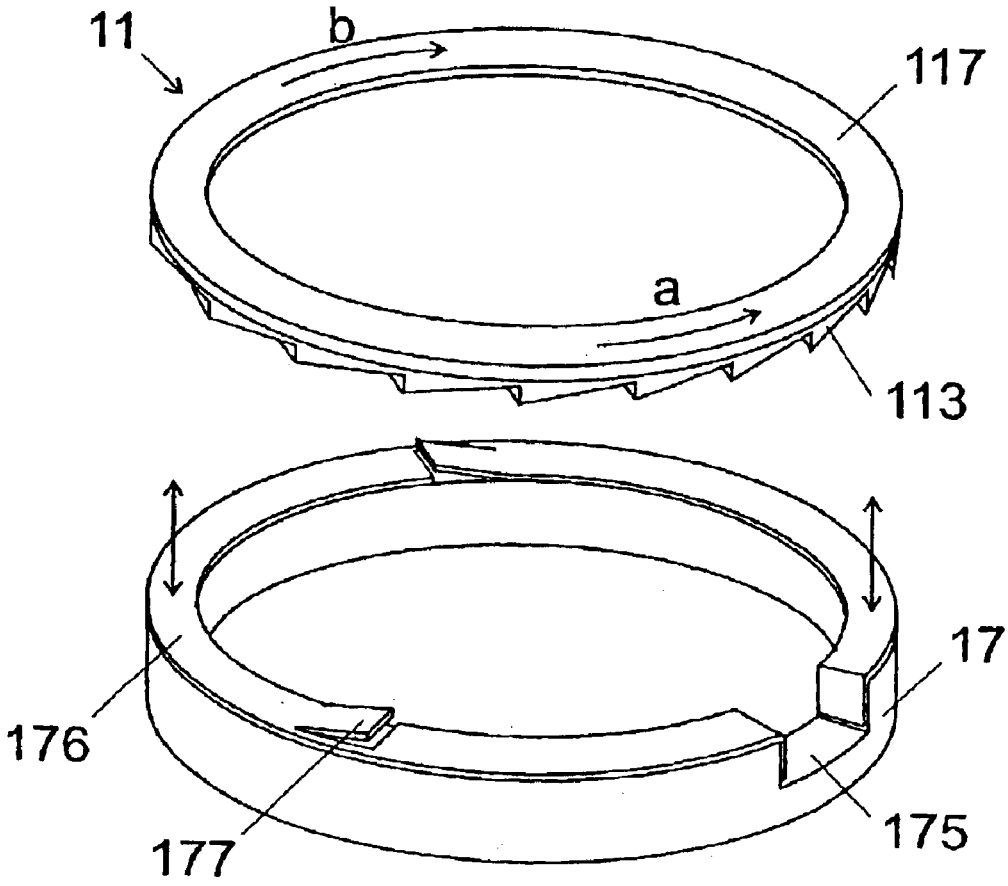
FIG. 8 shows a perspective view of a fitting ring equipped with a device for controlling the direction of rotation according to a third embodiment of the invention.

FIG. 8 illustrates a third embodiment of the device for controlling the direction of rotation of the flange, also using the latter's magnetization. Compared with the embodiment illustrated in the FIGS. 6 to 7, the pins 173 and the openings 172, that are relatively fastidious to manufacture, are replaced by a ring 176 (washer) directly placed on the fitting ring 17 and magnetically attracted towards the top of the figure by the magnetic part 17 of the flange 11. The flange again comprises a notched cage 113 under the magnetic part 117. The rotation of the washer 176 is in this case prevented by two portions folded back into the lodging 175 designed for the passage of the pin across the ring 17. Splits 177 have been cut out in several places in the washer 176 to form a raised tongue able to abut against a tooth of the flange 113, for example against a notched cage of the type illustrated in FIG. 7. The shape of the splits 177 and of the teeth 113 under the lower surface of the flange 111 is designed so as to allow the rotation of the latter only in the anti-clockwise direction illustrated by the arrow a. Additional guiding means can be used to ensure a vertical displacement of the ring 176.

The one skilled in the art will understand that the device for controlling the direction of rotation described here can also be used for controlling the rotation of other devices of the watch, for example of the bezel.

The one skilled in the art will understand that the magnetic bezel 14 can be used in the framework of this invention to control the position of other devices than the flange 11. By mounting the clock face 8 on a rotating axis and by attaching to it a magnetized ring or several discrete magnets, it is thus possible to make it pivot around its axis, for example to move the position of a window through which other indications are displayed. It is also possible to make a clock face in several parts, of which only a single part is driven by the bezel 14, or to drive a wheel or a gear disk, for example the date disk, by means of this mechanism, for example for selecting the time zone, for setting the hour and/or the date, for rewinding the watch or finally for controlling further functions of the watch, for example for initializing a count down of the chronograph or for setting an alarm. The information relative to the controlled function for each position of the bezel, for example regarding the selected time zone, can be provided on the latter and/or on an indicator inside the watch.

In the case of an electronic watch, it is also possible to convert the position of an organ driven by the bezel 14, for example the position of the flange 11, into an electric analogue or digital value controlling the electronics of the watch. This value can be used to control different functions of the watch. The position of the organ driven by the bezel can be detected for example by known types of angular photoelectric or capacitive encoders. It will be observed that this solution offers the advantage of not necessitating any electronic parts outside the waterproofed portion of the watch and no electric connection across the casing.

Furthermore, there is no need for electro-mechanic components such as magnetic interrupters.

It is further possible in the framework of this invention to combine the continuous displacement of an organ 11 with the triggering of a function of the watch when the bezel occupies one or several predetermined angular positions. For this purpose, the organ driven by the bezel 14 can comprise a cam in order to trigger different functions or to actuate different organs of the watch according to its angular position.

What is claimed is:

1. Watch case comprising:

a casing, a turning bezel outside of said casing, said turning bezel comprising at least one portion of magnetic material, an organ inside of said casing, placed so as to be able to be controlled by the magnetic field of said magnetic portion, wherein said organ is concentric to said turning bezel and equipped with at least one portion of magnetic material, so as to be able to be driven in rotation by the attraction between said portion of magnetic material of the bezel and said magnetic portion of the organ.

2. The watch case of claim 1, wherein said organ is of the analogue type and can take up an infinite number of distinct positions according to the angular position of said turning bezel.

3. The watch case of claim 2, wherein said organ carries indications that are visible through the glass of said watch case.

4. The watch case of claim 3, said watch case comprising a glass, said organ comprising a flange carrying indications visible through said glass.

5. The watch case of claim 4, wherein said indications correspond to a remaining time.

6. The watch case of claim 3, said watch case comprising a glass, said organ comprising at least a portion of the clock face visible through said glass.

7. The watch case of claim 1, wherein said organ comprises a gear wheel or disk of the watch.

8. The watch case of claim 7, wherein said gear wheel or said disk allows the selection of a time zone.

9. The watch case of claim 8, wherein the indications relative to the selected time zone are shown on said bezel.

10. The watch case of claim 1, comprising a ring integrally fixed to said turning bezel and fitted with a plurality of angular segments with alternating magnetic polarities.

11. The watch case of claim 1, comprising a ring integrally fixed to said organ and fitted with a plurality of angular segments with alternating magnetic polarities.

12. The watch case of claim 11, wherein at least one of said rings is produced by sintering on the basis of noble earth.

13. The watch case of claim 1, comprising a plurality of individual magnets integrally fixed to said turning bezel.

14. The watch case of claim 1, comprising a plurality of individual magnets integrally fixed to said organ.

15. The watch case of claim 1, wherein said organ is constituted by a cam mounted so as to trigger one or several different functions according to its angular position.

16. The watch case of one of the claims 1 to 15, comprising an organ for controlling the direction of rotation of said turning bezel.

17. The watch case of claim 1, comprising a device for controlling the direction of rotation of said organ.

18. The watch case of claim 17, wherein said device for controlling the direction of rotation of said organ comprises a flexed element integrally fixed to the fitting ring and able to cooperate with a portion of the organ to prevent its rotation in one direction.

19. The watch case of claim 17, wherein said device for controlling the direction of rotation of said organ comprises at least one element of magnetic material that is magnetically attracted by said organ to prevent its rotation in one direction.

20. The watch case of claim 19, wherein said at least one element of magnetic material comprises at least one pin placed freely in at least one opening and able to cooperate with a portion of said organ to prevent its rotation in one direction.

21. The watch case of claim 19, wherein said at least one element of magnetic material comprises a ring of irregular thickness placed freely on a supporting surface and able to cooperate with a portion of said organ to prevent its rotation in one direction.

22. The watch case of claim 21, wherein said ring is made from a ring of regular thickness in which splits have been cut out to form a surface able to abut against a portion of said organ to prevent its rotation in one direction.

23. Watch case comprising:

a casing, a turning bezel outside of said casing, said turning bezel comprising at least one magnetic portion, an organ inside of said casing, placed so as to be able to be controlled by the magnetic field of said magnetic portion, wherein said organ is of the analogue type and can take an infinite number of distinct positions according to the angular position of said turning bezel.

24. Watch case comprising at least one turning organ and a device for controlling the direction of rotation of said organ, said turning organ comprising at least one magnetic portion, wherein said device for controlling the direction of rotation comprises at least one element of magnetic material that is magnetically attracted by said turning organ to prevent its rotation in one direction.

25. The watch case of claim 24, wherein said at least one element comprises at least one pin placed freely in at least one opening and able to cooperate with a portion of said organ to prevent its rotation in one direction.

26. The watch case of claim 24, wherein said at least one element comprises a ring of irregular thickness placed freely on a supporting surface and able to cooperate with a portion of said organ to prevent its rotation in one direction.

27. The watch case of claim 26, wherein said ring is made from a ring of regular thickness in which splits have been cut out to form a surface able to abut against a portion of said organ to prevent its rotation in one direction.

28. Watch case comprising:

a casing, a turning part outside of said casing, said turning part comprising at least one portion of magnetic material, an analogue organ inside of said casing, wherein said organ is equipped with at least one portion of magnetic material, so as to be able to be driven in rotation by the attraction between said portion of magnetic material of the turning part and said magnetic portion of the organ.

29. The watch case of claim 28, said watch case comprising a glass, and wherein said organ carries indications that are visible through said glass.

30. The watch case of claim 28, wherein said organ is of the analogue type and can take up an infinite number of distinct positions according to the angular position of said turning bezel.

* * * * *